United States Patent [19]

Horn

[11] 3,970,230

[45] July 20, 1976

[54] TAPE TEARING DEVICE

[76] Inventor: Alexander Horn, 624 Hazelhurst Ave., Merion, Pa. 19066

[22] Filed: Feb. 5, 1975

[21] Appl. No.: 547,124

[52] U.S. Cl. ..... 225/65; 225/56; 225/89

[51] Int. Cl.[2] ..... B26F 3/02

[58] Field of Search ..... 225/19, 22, 55, 56, 225/59, 60, 61, 77, 89, 57, 58, 65, 66

[56] References Cited

UNITED STATES PATENTS

| | | | |
|---|---|---|---|
| 2,677,425 | 5/1954 | Broyles | 225/56 |
| 2,734,576 | 2/1956 | Slezak | 225/65 |

FOREIGN PATENTS OR APPLICATIONS

| | | | |
|---|---|---|---|
| 243,502 | 10/1960 | Australia | 225/56 |
| 156,426 | 10/1952 | Australia | 225/56 |
| 498,366 | 1/1951 | Belgium | 225/56 |
| 1,224,656 | 6/1960 | France | 225/56 |
| 533,746 | 9/1955 | Italy | 225/56 |
| 270,395 | 8/1950 | Switzerland | 225/61 |

*Primary Examiner*—J. M. Meister
*Assistant Examiner*—Fred A. Silverberg
*Attorney, Agent, or Firm*—Weiser, Stapler & Spivak

[57] ABSTRACT

A tape tearing device for removably applying to a roll of pressure sensitive tape comprises a generally U-shaped cutter including a blade affixed to the web of the cutter, the web terminating endwardly in a pair of depending, integral legs. The legs terminate downwardly in inwardly projecting shoulders suitable to loosely grip the core of a roll of tape. The legs are spaced apart a distance slightly greater than the width of the roll of tape and the shoulders extend inwardly a predetermined distance to define a clear space therebetween that is less than the width of the tape whereby the tape tearing device may be easily applied to a roll of tape by slightly spreading the legs and then the device is retained in association therewith by the natural spring bias of the legs.

4 Claims, 7 Drawing Figures

FIG. 1
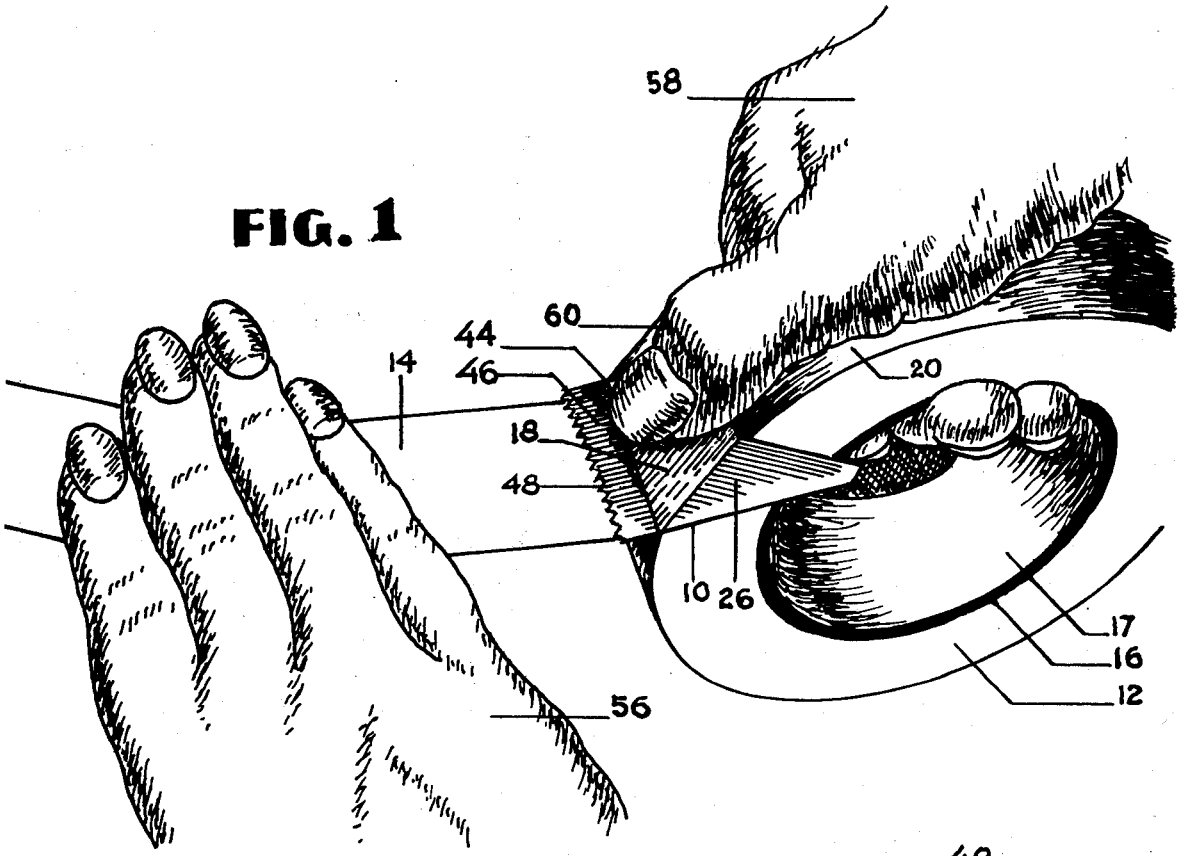
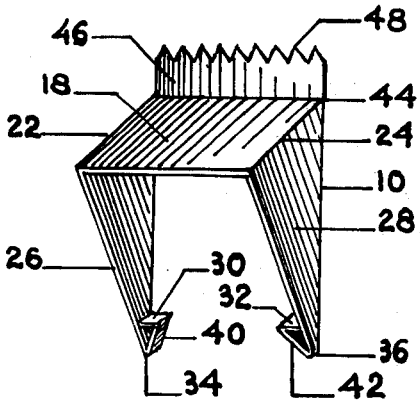
FIG. 2
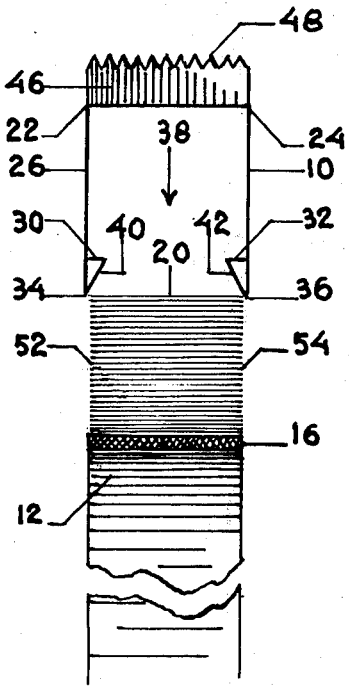
FIG. 3

TAPE TEARING DEVICE

BACKGROUND OF THE INVENTION

This invention relates generally to the field of portable tape rolls and more particularly, is directed to a tape tearing device associated therewith.

Many prior workers in the field have attempted to design tape dispensers and cutters for use with portable rolls of pressure sensitive tape. The devices, disclosed in U.S. Pat. Nos. 2,229,961, 2,447,518, and 2,670,042 are exemplary of the existing types of tape dispensers. All of the devices disclosed in the above cited patents include a cutting member having a saw tooth cutting edge which is disposed transversely of the tape to facilitate severing the tape and the desired location.

While there are several known prior art types of tape dispensers, all of the known dispensers are relatively complicated in construction, are rather expensive in fabrication and are cumbersome in the application to the roll of tape.

SUMMARY OF THE INVENTION

This invention relates generally to the field of pressure sensitive tape dispensers, and more particularly, is directed to an extremely simple, readily applied type of tape tearing device which can be easily packaged in the same container as the roll of tape itself.

The tape tearing device of the present invention is generally U-shaped in configuration and includes a web section which transversely overfits the roll of tape and supports a metallic or other material cutting blade for tape cutting purposes. The web terminates endwardly in a pair of spaced, integral, depending legs which are spaced apart a distance slightly greater than the width of the roll of tape. The legs terminate downwardly in inwardly projecting shoulders and the legs are of sufficient length to radially overly the side of the tape roll a sufficient distance to allow the projections to inwardly project over the tape core, to thereby retain the dispenser in association with the roll of tape in a relatively simple manner. It will be noted that the legs are integral with the web and extend downwardly from the web to thereby impart a spring action or natural resiliency to the construction. Thus, by flexing the legs slightly outwardly, a sufficient distance can be provided between the spaced projections to slip the tape tearing device over the sides of the roll of tape prior to use. When the projections are pushed radially inwardly past the core into the interior space defined by the core, the natural resiliency of the tape tearing device material pulls the legs together to the initial position, thereby locking the projections below the core to prevent easy disassociation of the tape tearing device from the tape roll.

It is therefore an object of the present invention to provide an improved tape tearing device of the type set forth.

It is another object of the present invention to provide a novel tape tearing device that is generally U-shaped in configuration and which includes a web upon which is mounted a saw tooth cutting blade, the web further carrying a pair of depending legs for locking the tape tearing device to a roll of tape in an easily applied manner.

It is another object of the present invention to provide a novel tape tearing device which includes a pair of transversely positioned legs which each terminate downwardly in an inward projection, the projections locking over the core of a roll of tape to thereby loosely lock the tape cutting device to the roll of tape.

It is another object of the present invention to provide a novel tape cutting device that is generally U-shaped in configuration and having a blade supporting web section and a pair of depending legs, the legs including spring action and a pair of inwardly projecting shoulders, the spring action of the legs and the inwardly projecting shoulders serving to facilitate quick application of the tape cutting device to a roll of tape.

It is another object of the present invention to provide a novel tape cutting device that is extremely simple in construction which comprises a web section which supports a cutting blade and a pair of depending, locking legs, the web and the legs forming a generally U-shaped configuration of size to readily fit within the container used for packaging a roll of pressure sensitive tape.

It is another object of the present invention to provide a novel tape cutting device that is extremely simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is a perspective view showing the device of the present invention in use.

FIG. 2 is a perspective view of a tape cutting device constructed in accordance with the teaching of the present invention.

FIG. 3 is a side elevational view showing the tape cutting device immediately prior to its application to a roll of pressure sensitive tape.

DESCRIPTION OF THE PREFERRED EMBODIMENT OF THE INVENTION

Figure 4:
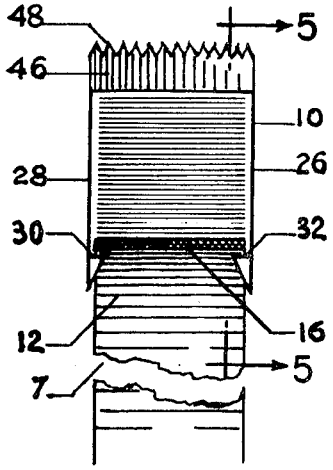
FIG. 4 is a view similar to FIG. 3, partially broken away, showing the tape cutting device after it has been applied to a roll of pressure sensitive tape.
Figure 5:
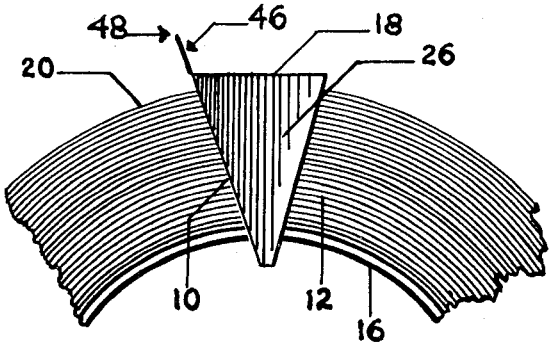
FIG. 5 is a side elevational view taken along Line 5—5 of FIG. 4, looking in the direction of the arrows.

Although specific terms are used in the following description for the sake of clarity, these terms are intended to refer only to the particular structure of my invention selected for illustration in the drawings and are not intended to define or limit the scope of the invention.

Referring now to the drawings, I show in FIG. 1 a tape cutting device 10 as applied to a roll 12 of pressure sensitive tape 14. The tape 14 is coiled about a cylindrical core 16 in well known manner prior to use and the core defines a cylindrical interior space 17 which may be conveniently employed for holding the tape as illustrated. The tape cutting device 10 of the present invention is quite small in comparison to the size of the tape roll 16 and can be readily packed within the same carton (not shown) which is utilized for roll packaging purposes. The tape cutter 10 of the present invention is very inexpensive in manufacture and can be easily applied to the roll of tape 12 as illustrated in a manner to prevent easy disassociation after the cutter has been applied to the roll.

Figure 7:
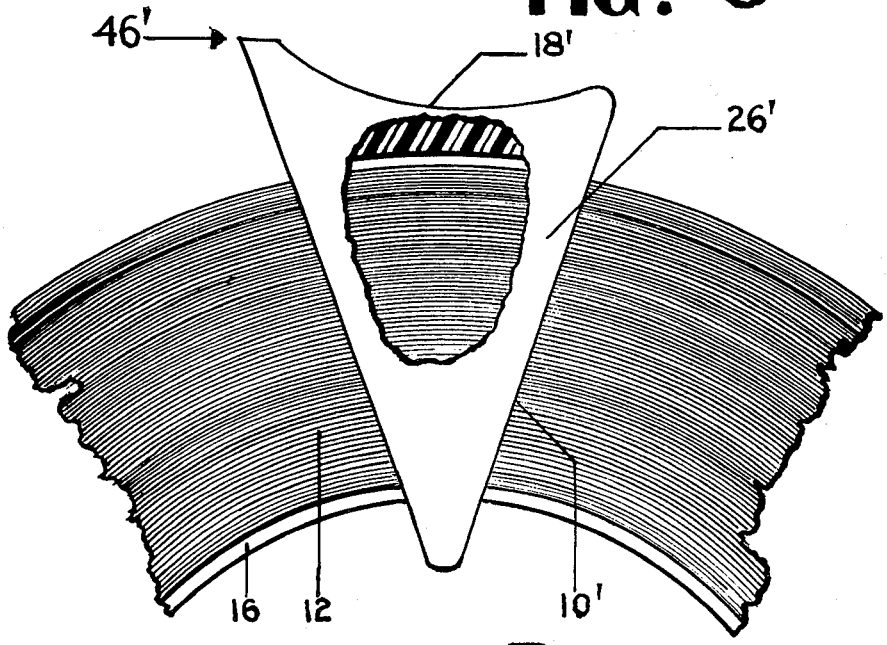
FIG. 7 is a side elevational view similar to FIG. 5, showing another modified tape cutting device.

As best seen in FIGS. 1, 2 and 3, the tape cutter 10 is generally U-shaped in configuration and includes a generally planar top web 18 which closely overlies the outer periphery 20 of the tape roll 12 when in use. If desired, the web 18 may be curved slightly to approximate the configuration of the arc of the roll 12 at the outer periphery 20 thereof. See 18' in FIG. 7. However, in view of the relatively small area of contact between the cutter 10 and the outer periphery 20 of the tape roll 12 when the device is in use, such curvature may not add significant advantages in all instances. The feasibility of employing a curved web would generally be a function of the type of material utilized for the tape 14.

Figure 6:
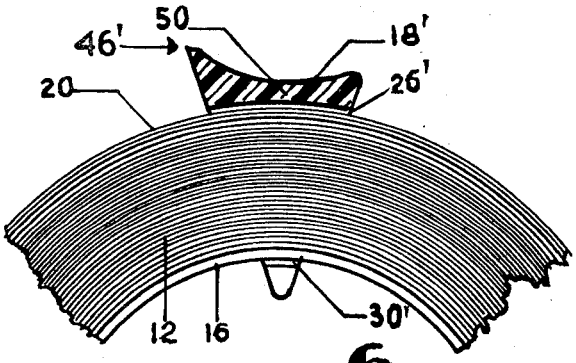
FIG. 6 is a sectional view showing a modified tape cutting device applied to a roll of pressure sensitive tape.

The web 18 terminates laterally at its transverse edges 22, 24 in a pair of spaced, depending legs 26, 28 which may be of triangular configuration to facilitate locking to the roll 12. The legs 26, 28 terminate downwardly in inwardly projecting shoulders 30, 32 which are employed to grip under the core 16 of the tape roll 12 when the device is in use. If the legs are fabricated of sheet metal, the shoulders 30, 32 can be readily formed by bending as illustrated in FIG. 2. Accordingly then, the shoulders 30, 32 should be spaced from the web 18 a distance sufficient to accommodate the entire thickness of a new tape roll 12, for example, approximately one inch. Of course, the distance from the web 18 to the shoulders 30, 32 can be varied within a relatively wide range to accommodate the cutter 10 to any size roll of tape. It is contemplated that the tape cutter 10 may be formed of any suitable lightweight, generally rigid, sheet material of suitable strength for the purpose. For example, the tape dispenser 10 as illustrated in FIGS. 2–5 could be fabricated of relatively light gage sheet steel or sheet aluminum. As illustrated in FIG. 6, the tape dispenser 10' could be formed of a suitable plastic material, for example, polyvinyl chloride or polyethylene plastic.

The web 18 and the depending legs 26, 28 are preferably fabricated of unitary construction and the legs 26, 28 are spaced apart a distance only slightly greater than the width of the roll 12. It will be noted that the shoulders 30, 32 will normally be spaced apart a distance less than the width of the tape roll 12. In applying the tape cutter 10 to the roll 12, it will be noted that the legs 26, 28 cantilever from the web 18 and, depending upon the natural properties of the material of construction, have a certain flexure or resiliency. Accordingly, in order to apply the cutter 10 to the roll 12, as seen in FIGS. 2 and 4, the respective bottoms 34, 36 of the shoulders 30, 32 are applied to the outer periphery 20 of the roll 12 and the cutter 10 is forced radially inwardly in the direction of the arrow 38. It will be noted that each shoulder construction includes an inwardly inclined side 40, 42 which serves to force the legs 26, 28 slightly outwardly as the cutter 10 is applied to the roll 12. When the cutter has been pushed in the direction of the arrow 38 fully inwardly, the shoulders 30, 32 will position inwardly of the core 16 and within the interior space 17. The natural memory of the cutter construction material will return the legs 26, 28 to their original parallel, spaced condition whereby the shoulders 30, 32 will loosely lock under the core 16 in a relatively free engagement. With the tape cutter 10 fully applied to the roll 12 as in FIGS. 4 and 5, the cutter 10 can then be freely rotated about the roll 12 to any desired position prior to cutting the tape 14.

The leading edge 44 of te tape cutter web 18 is upwardly bent or otherwise treated to receive and retain therein in stationary engagement a tape cutting blade 46 which preferably includes a plurality of teeth 48 arranged in saw tooth pattern. The blade 46 is positioned at right angles to the longitudinal axis of the tape 14 to facilitate the tape severing operations. The blade 46 extends the full width of the web 18 to thereby permit the tape to be torn either from right to left or from left to right.

As illustrated in FIG. 6, a modified, unitary tape cutter 10' can be formed of plastic material 50 which may be molded or otherwise formed to the same general configuration as illustrated in FIG. 2. The legs (only one leg 26' being illustrated) depend from the top web 18' and terminate downwardly in similar locking shoulders (only shoulder 30' being shown). The top web 18' is suitably formed to receive and retain therein a cutting blade 46' which may be of metal or plastic as necessary to cut the tape 14. The modified tape cutter 10' of FIG. 6 will be applied to a roll of tape 12 precisely the same manner as hereinbefore set forth with regard to the tape dispenser 10 and will function in the same manner.

In order to use the tape tearer or cutter 10 or 10' of the present invention, the tape tearing device is applied to the roll 12 by pressing the cutter 10 radially inwardly in the direction of the arrow 38 (FIG. 3) thereby forcing the inclined sides 40, 42 radially inwardly against the outer periphery 20 of the tape roll 12. The applied forces will slightly spread the legs 26, 28 sufficiently to allow the shoulders 30, 32 to pass downwardly along the sides 52, 54 of the tape roll 12 until the shoulders 30, 32 are pushed inwardly clear of the tape core 16 into the interior space 17. In this condition, as seen in FIG. 4, natural memory of the tape cutter material will cause the legs 26, 28 to return to their parallel relationship to thereby lock the shoulders 30, 32 beneath the core 16.

With the shoulders 30, 32 locked below the core 16, the cutter 10 can then be freely rotated about the tape roll 12 to any desired circumferential location without fear that the tape tearing device can inadvertently become loose. With the cutter 10 thus applied, as best seen in FIG. 1, a section of tape 14 can be unrolled from roll 12 and pressed into a desired position by one hand 56 of the user. Then by pressing the web 18 of the cutter 10 against the outer periphery 20 of the rape roll 12 by applying one finger 60 of the other hand 58, the cutter can be temporarily, stationarily held against the roll 12 and the teeth 48 of the blade 46 can be applied against the tape 14. Then by either pressing and twisting the tape 14 relative to the blade teeth 48 by using the hand 56 or by pressing and twisting the blade 48 relative to the tape 14 by twisting the hand 58, the tape 14 can be readily severed in any predetermined desired position.

Although I have described the present invention with reference to the particular embodiments herein set forth, it is understood that the present disclosure has been made only by way of example and that numerous changes in the details of construction may be resorted to without departing from the spirit and scope of the invention. Thus, the scope of the invention should not be limited to the foregoing specification, but rather only by the scope of the claims appended hereto.

I claim:

1. In a roll tape tearing device removably applied to a roll of tape having a thickness defined between an outer periphery and an inner core, the said tearing device including:

A. a web transversely overlying the outer periphery of the tape roll, 1. said web having a length slightly greater than the width of the tape roll;

B. a pair of spaced, generally parallel legs depending from the transverse edges of the web, 1. said legs extending in length a distance that is greater than the thickness of the roll of tape,
2. said legs terminating downwardly in a shoulder construction,
   a. said shoulder construction including inwardly projecting shoulders, the space between the shoulders normally being less than the width of the tape roll whereby the shoulders act to retain the dispenser in association with the tape roll at the said core thereof,
   b. the shoulder construction comprising an inwardly inclined planar surface the inwardly inclined planar surface contacting the outer periphery of the tape at an angle of less than 90° to spread a portion of the legs when the tearing device is applied to the roll of tape; and C. cutter blade means carried by the web to sever the tape.

2. The roll tape tearing device of claim 1, wherein the cutter blade means comprise a blade connected to the web, said blade having a cutting edge, the cutting edge facing away from the roll of tape.

3. The roll tape tearing device of claim 1, wherein the top web is formed to a curved configuration to facilitate frictional engagement of the device to the roll during the tape tearing operation, the curved configuration of the web being substantially equal to the curved configuration of the outer periphery of the roll of tape.

4. The roll tape tearing device of claim 3, wherein the curved configuration of the web is approximately equally spaced from the curved configuration of the outer periphery of the tape roll.

* * * * *